United States Patent [19]

Knoll

[11] Patent Number: 4,846,205

[45] Date of Patent: Jul. 11, 1989

[54] BEACH RAP

[76] Inventor: William D. Knoll, 13320 Darnestown Rd., Gaithersburg, Md. 20878

[21] Appl. No.: 242,180

[22] Filed: Sep. 9, 1988

[51] Int. Cl.[4] ..... E04H 15/44; E04H 15/48

[52] U.S. Cl. ..... 135/106; 135/109; 135/114; 403/291

[58] Field of Search ..... 135/901, 902, 106, 109, 135/114; 403/29, 166, 220

[56] References Cited

U.S. PATENT DOCUMENTS

| | | | |
|---|---|---|---|
| 2,652,845 | 9/1953 | O'Neill et al. | 135/902 X |
| 2,827,065 | 3/1958 | Chapron | 135/106 |
| 2,848,756 | 8/1958 | McCann | 135/106 X |
| 2,980,124 | 4/1961 | Atchinson | 135/106 X |
| 3,303,851 | 2/1967 | Grunfeld | 135/106 |
| 3,448,748 | 6/1969 | Walrave | 135/114 X |
| 3,635,233 | 1/1972 | Robertson | 135/114 X |
| 4,068,479 | 1/1978 | Lane, Jr. | 403/220 X |
| 4,084,598 | 4/1978 | Rainwater | 135/106 |
| 4,646,770 | 3/1987 | Labato | 135/106 X |

FOREIGN PATENT DOCUMENTS

| | | | |
|---|---|---|---|
| 274284 | 7/1927 | United Kingdom | 135/902 |

*Primary Examiner*—David A. Scherbel
*Assistant Examiner*—Lan Mai

[57] ABSTRACT

The apparatus, used primarily on the beach, protects user from wind and blowing sand, as well as providing minimal shade from sun. The framework, made of rigid, plastic pipe, is held together by a braided nylon elastic cord, and it is sewn into a flexible sheet of nylon, creating an integrated unit which is completely collapsible for easy transport and storage. The apparatus is anchored by two uprights embedded in the sand and sand pockets sewn into the bottom of the unit which can be filled with said and emptied.

3 Claims, 1 Drawing Sheet

BEACH RAP

FIELD OF THE INVENTION

This invention relates to beach equipment for use in controlling wind and blowing articles on a sand beach. More particularly, this invention relates to thin, flexible environment controlling materials and means for their use in a beach setting, providing for easy handling and storage as well as economy of space.

BACKGROUND OF THE INVENTION

Vacationers, at ocean beaches in particular, often encounter strong winds that are generally present at seashores, making sunbathing and relaxing on the beach uncomfortable due to blowing sand and debris. Vacationers will often lay down a beach umbrella on its side to act as a windshield, creating the extreme danger of impalement by the umbrella pole if the wind unlodged the umbrella.

Therefore, this invention is designed to protect the user from these elements, while not imposing any danger or hinderance to other beach goers. It is relatively small, standing 27" high, and lightweight. Sand pockets are sewn into the bottom of the unit, and when filled, provided a stable anchor, along with the two longer uprights embedded in the sand. The two wings of the apparatus are adjustable to act as braces against the back panel, which directly buffets the wind. Being an integrated unit, the invention avoids the nuisance of loose parts, and when collapsed, it takes up no more room than a common umbrella.

DESCRIPTION OF THE DRAWINGS

The preferred embodiment of the invention herein shown is illustrated in the accompanying drawings in which.

DETAILED DESCRIPTION OF THE INVENTION

Figure 2:
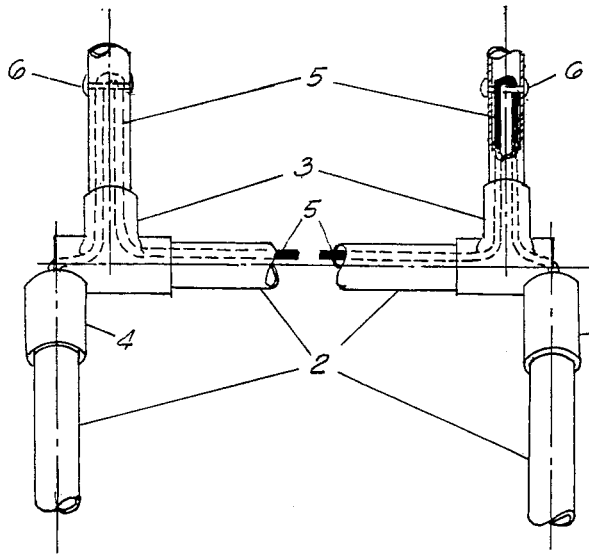
FIG. 2 is a partial plan view of the framework.
Figure 3:
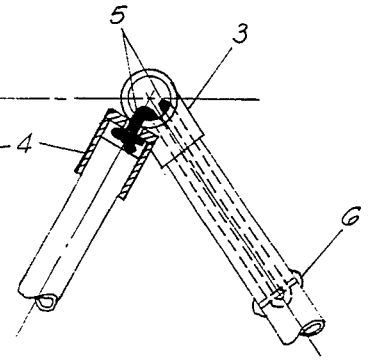
FIG. 3 is a side view in partial cross-section of the framework.

The preferred embodiment of the invention herein shown provides a wind and sand barrier for its user on the beach. The base element comprises a frame 2 made of ½" rigid plastic pipe which is fitted into sleeves sewn into a flexible sheet of nylon 1. The framework is comprised of ½" plastic pipe fittings, an open "tee" fitting 3 and ½" plastic end caps 4, braided nylon elastic cord 5 stretched through the pipe, and ⅝" pop rivets 6. Holes are drilled into the end of the endcaps to allow passage of the elastic cord, which is then knotted on the inside of the cap 4 FIG. 3. The cap is glued to the end of diagonal upright pipe which has been previously positioned into sleeve of flexible nylon sheet 1. An approximate length of cord is cut and fed through the tee fitting 3 from the end cap 4, then fed down through a vertical upright pipe approximately 5" deep forming a loop through which a pop rivet is attached 6, then fed back through same tee fitting and through the horizontal cross-member 2 which also has been previously placed in the sleeve sewn into the top of the nylon sheet. The cord is then fed through the second tee fitting, looped around the rivot in the second vertical upright 6, back through the second tee and knotted on the backside of the second endcap, which is then glued onto the second diagonal upright already in its sleeve. This system provides for a collapsible apparatus which has no loose parts. The pieces of this frame can be loosened from each other by stretching the internal elastic cord pulling the parts apart, except the glued endcaps. The elastic cord 5 also creates a universal joint @5 FIG. 3, wherein the diagonal uprights can be positioned at any angle. To collapse the apparatus, the bottom of each diagonal upright is folded toward the opposite tee fitting, then the vertical uprights are pulled down, loosening them from the tee fittings, and folded up in a like manner. The apparatus is then rolled around the horizontal cross-member and secured with a strap of velcro sewn into the top of the apparatus in the same manner as an umbrella strap.

Figure 1:
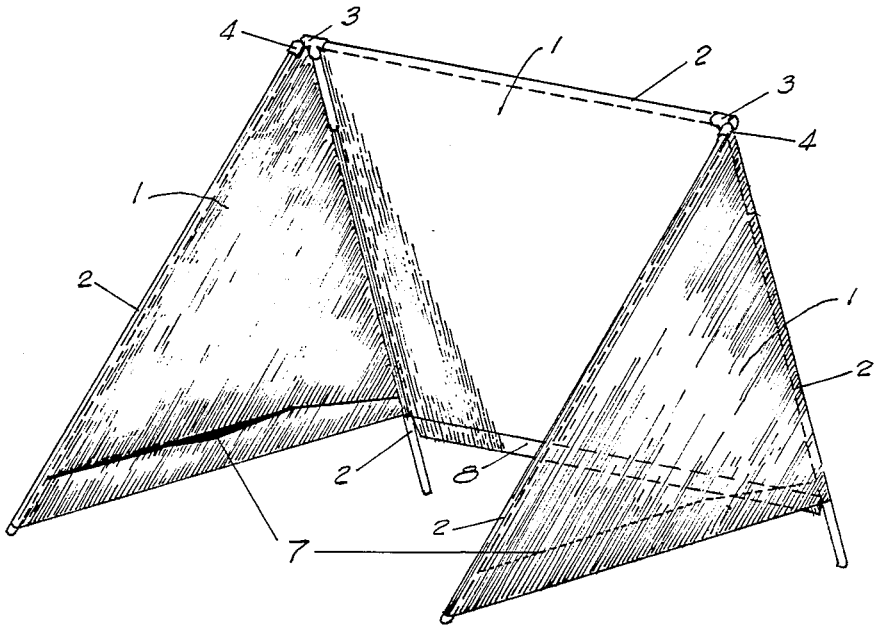
FIG. 1 is a front/side elevation view of the apparatus with shading indicating a flexible sheet of nylon.

At the bottom of the apparatus, sand pockets are sewn 7 into the nylon approximately 4" deep which can be filled through the top of the pocket and emptied through the side which is not sewn. Also a flap of nylon 8 is extended on the bottom of the midsection, to be folded out flat towards the outside of the apparatus so that sand can be piled on it and around the sides, providing a seal against wind and blowing sand entering underneath the apparatus. Also, as seen in FIG. 1, the vertical uprights are extended below the fabric approximately 4" to be embedded in the sand providing more stability.

Various modifications of the preferred embodiment will now be apparent to those skilled in the art and therefore it is not intended to confine the invention to the precise form herein shown but rather to limit it in terms of the appended claims.

I claim:

1. A collapsible apparatus for protection against wind and blowing sand on a beach comprising a unitary flexible sheet nylon covering and an integrated frame which including sections of rigid plastic pipe and plastic fittings; said frame comprising first and second parts;

said first part comprises of upright and horizontal pipe sections said joined by plastic fittings to form a rectangular frame with two corners, said second part comprising at least one diagonal brace having two ends;

a braided nylon elastic cord holding said first and second frame parts together by forming a universal joint between one end of said brace and one of said corner, and sleeves sewn into said flexible sheet nylon to accommodate said frame parts.

2. The apparatus of claim 1 wherein sand pockets are sewn into lower edge of said flexible sheet nylon for stability.

3. The apparatus of claim 1 wherein said ends of said diagonal brace are covered by end caps.

* * * * *